US007063316B2

(12) United States Patent
Graef et al.

(10) Patent No.: US 7,063,316 B2
(45) Date of Patent: Jun. 20, 2006

(54) AUTOMATED BANKING MACHINE CURRENCY DISPENSER MODULES

(75) Inventors: H. Thomas Graef, Bolivar, OH (US); Michael S. Johnson, Akron, OH (US); Michael Harty, North Canton, OH (US); Jonathan M. Peritt, Clinton, OH (US); Ken Kontor, Chesterland, OH (US)

(73) Assignee: Diebold Self-Services Systems Division of Diebold, Incorporated, North Canton, OH (US)

( * ) Notice: Subject to any disclaimer, the term of this patent is extended or adjusted under 35 U.S.C. 154(b) by 230 days.

(21) Appl. No.: 10/737,582

(22) Filed: Dec. 15, 2003

(65) Prior Publication Data

US 2004/0145106 A1 Jul. 29, 2004

Related U.S. Application Data

(60) Provisional application No. 60/433,888, filed on Dec. 16, 2002, provisional application No. 60/433,889, filed on Dec. 16, 2002.

(51) Int. Cl.
*B65H 1/00* (2006.01)

(52) U.S. Cl. ..... 271/162; 271/145; 399/110

(58) Field of Classification Search ..... 271/9.01, 271/162, 148, 145, 207, 9.11; 221/278, 197; 399/110; 312/330.1; 109/24.1, 45, 47
See application file for complete search history.

(56) References Cited

U.S. PATENT DOCUMENTS 4,380,316 A 4/1983 Glinka et al.
4,595,828 A 6/1986 Ludblad
5,483,047 A 1/1996 Ramachandran et al.
5,619,932 A * 4/1997 Efland et al. ..... 109/24.1
5,632,542 A * 5/1997 Krivec ..... 312/334.7
5,683,159 A * 11/1997 Johnson ..... 312/334.7
5,740,897 A * 4/1998 Gauselmann ..... 194/206
5,772,294 A * 6/1998 Hendrich et al. ..... 312/221
5,984,177 A 11/1999 Do et al.
5,997,114 A * 12/1999 Bischoff ..... 312/215
6,010,065 A * 1/2000 Ramachandran et al. ... 235/379
6,082,519 A * 7/2000 Martin et al. ..... 194/350
6,082,616 A * 7/2000 Lewis et al. ..... 235/379
6,199,967 B1 * 3/2001 Bayles et al. ..... 312/334.7
6,206,284 B1 3/2001 Do et al.
6,209,979 B1 * 4/2001 Fall et al. ..... 312/330.1
6,318,679 B1 * 11/2001 Yang et al. ..... 248/27.1
6,328,206 B1 12/2001 Schanz et al.
6,377,447 B1 * 4/2002 Boe ..... 361/685
6,406,201 B1 * 6/2002 Beretta et al. ..... 400/605

(Continued)

*Primary Examiner*—Kathy Matecki
*Assistant Examiner*—Rakesh Kumar
(74) *Attorney, Agent, or Firm*—Daniel D. Wasil; Ralph E. Jocke; Walter & Jocke

(57) ABSTRACT

Dispenser modules include structure permitting their securement in stacked and aligned relation. The dispenser modules can contain multimedia. The dispenser modules can be used in an automated banking machine operative to dispense multimedia. Modules can include a projection plate and a biasing latch arm on side walls thereof. The projection plate includes a pin operative to be received in a side wall slot. A first module is locked to a second module due to a first module latch preventing movement of a second module pin from a first module slot. Disassembly of the locked modules can occur with compressing of the latch to release the modules relative to each other.

33 Claims, 8 Drawing Sheets

U.S. PATENT DOCUMENTS 6,464,085 B1 * 10/2002 Chin et al. ..... 211/26
6,527,172 B1 3/2003 Lewis et al.
6,578,937 B1 * 6/2003 Thoman ..... 312/107
6,719,120 B1 * 4/2004 Kato ..... 194/206
6,722,749 B1 * 4/2004 Pagac ..... 312/221
6,814,518 B1 * 11/2004 Luciano et al. ..... 400/691

* cited by examiner

AUTOMATED BANKING MACHINE CURRENCY DISPENSER MODULES

CROSS REFERENCE TO RELATED APPLICATION

This Application claims benefit under 35 U.S.C. § 119(e) of Provisional Application Serial Nos. 60/433,888 and 60/433,889 filed Dec. 16, 2002.

TECHNICAL FIELD

This invention relates to automated banking machines. Specifically, this invention relates to currency dispensers for automated banking machines and the securement of dispenser modules in such machines.

BACKGROUND ART

Automated banking machines are known in the prior art. One type of automated banking machine, known as an automated teller machine (ATM), allows a consumer to conduct banking transactions without the necessity of a banking employee directly taking part. Such transactions might include making deposits to accounts, checking balances, transferring funds, obtaining a cash withdrawal, or obtaining other items. As used herein, the phrase automated banking machine is not intended to limit the scope of the disclosure, but may include any type of device that enables automating transactions involving transfers representative of value.

Other types of automated banking machines may be used to dispense currency to a customer, bank teller, cashier or other service provider. Automated banking machines may be used to dispense various types of items to users. Some types of automated banking machines may dispense items such as tickets, coupons, vouchers, or other items of value. Automated banking machines generally store a multitude of such items in a fashion enabling the machine to quickly deliver one or more items without error. Some automated banking machines may accept deposits in the form of envelopes, checks, cash, or other items. Some automated banking machines may be used for providing credit, making bill payments, or to debit or deposit funds in various accounts.

The devices enabling storage and delivery of the sheet items may at times require replenishing, maintenance, or repair. In automated banking machines such as those made by Diebold, Incorporated, the assignee of the present invention, sheet items that are dispensed are generally held in cassettes. The cassettes are enabled to be replaced by authorized personnel who have gained access to a secure chest portion of the machine which houses the cassettes. This enables authorized personnel to quickly replenish items to be dispensed. This can be done by replacing the cassettes or by removing the cassettes, adding sheets thereto and reinstalling the cassettes.

While replenishing sheet items may readily be accomplished, it is sometimes necessary to conduct more extensive maintenance or repair activities. In the event repair or replacement of certain components of the machine are necessary, the sheet dispenser assembly may need to be removed from the housing. The weight and delicate nature of some components of the sheet dispenser assembly can make removal and reinstallation of the dispenser mechanism difficult. The dispenser mechanism may also include a number of stacked dispenser modules for storing and selectively dispensing documents stored in the cassettes. The stacked dispenser modules may also need to be disassembled. Very accurate positioning and alignment of dispenser mechanism components are often required for proper operation of the machine, which necessitates care during reinstallation. The proper alignment and securement of stacked dispenser modules are also required. All of these requirements add to the difficulty in servicing the dispenser mechanism.

It may also be useful in some situations to add dispenser modules to an automated banking machine. Adding dispenser modules enables additional types of items or more of a particular type of item to be dispensed in transactions carried out through operation of the machine.

DISCLOSURE OF INVENTION

Thus there exists a need for an apparatus and method for more easily removing, disassembling, and reinstalling a sheet dispenser assembly of an automated banking machine to facilitate servicing of components of the machine. There further exists a need for more easily adding a sheet dispenser mechanism to an automated banking machine.

It is an object of an exemplary form of the present invention to provide a dispenser module for an automated banking machine.

It is a further object of an exemplary form of the present invention to provide a stackable dispenser module for an automated banking machine.

It is a further object of an exemplary form of the present invention to provide a stackable multimedia dispenser module for an automated banking machine.

It is a further object of an exemplary form of the present invention to provide a dispenser module which can be locked to another dispenser module in stacked relation.

It is a further object of an exemplary form of the present invention to provide a dispenser module which can be locked to another dispenser module in aligned relation.

It is a further object of an exemplary form of the present invention to provide a dispenser module which can be locked to another dispenser module in stacked and aligned relation.

It is a further object of an exemplary form of the present invention to provide a multimedia dispenser module which can be locked to another dispenser module in stacked and aligned relation for use in an automated banking machine.

It is a further object of an exemplary form of the present invention to provide an apparatus which enables a sheet dispenser of an automated banking machine to be more readily serviced.

It is a further object of an exemplary form of the present invention to provide a method of servicing an automated banking machine.

It is a further object of an exemplary form of the present invention to provide a method of assembling dispenser modules into locked and stacked relation for a sheet dispenser arrangement of an automated banking machine.

It is a further object of an exemplary form of the present invention to provide a method of disassembling dispenser modules from a locked and stacked relation.

It is a further object of an exemplary form of the present invention to provide a method of servicing a sheet dispenser of an automated banking machine that reduces the time and cost of removing and reinstalling dispenser modules.

It is a further object of an exemplary form of the present invention to provide a method of adding a sheet dispenser to an automated banking machine.

Further objects of exemplary forms of the present invention will be made apparent in the following Best Modes for Carrying Out Invention and the appended claims.

The foregoing objects are accomplished in an exemplary embodiment of the invention which involves servicing an automated banking machine. The machine includes dispenser modules which can be selectively operated to dispense valuable documents or sheets (e.g., items). The items may include for example, currency, coupons, tickets, scrip, vouchers, and phone cards. The dispenser modules include structure which permits their securement to each other in stacked and aligned relation. Each module includes a pair of side walls. Each module includes a projection plate and a biasing latch arm on each side wall. The projection plates can be attached to the side walls. The latches can be cut out from the sidewalls. Each projection plate includes a pin in supporting connection therewith. Each side wall includes a slot adapted to receive a pin.

Biasing tabs can also be cut out from the sidewalls. The tabs are operative to guide and retain the projection plates during the secured stacking of the modules.

During a stacking assembly the projection plates are operative to compress the latches. The latches are arranged to snap outward once a plate has slid beyond latch compression and toward alignment of the module. Once a latch has snapped outward the plate is no longer enabled to move in the opposite direction unless a servicer deliberately moves the latch inward against the biasing force thereof.

Adjacent modules can be locked so as to be secured to each other due to latches preventing the movement of pins from slots. That is, the projection plates are prevented from movement in a first direction, by engagement of the pins with the side walls, and from movement in a second opposite direction, by engagement of the projection plates with the latches. The tabs can also be used to retain the pins in the slots.

Modules can be unlocked and separated by compressing the latches, such as with a tool, to allow movement of the modules relative to each other.

Having easier ability to securely align and stack dispenser modules can facilitate repairs and/or replacement of dispenser mechanism components and/or automated banking machine components by service personnel. Sometimes it is desirable or necessary to entirely remove one or more dispenser mechanisms from the machine for service or replacement. The present invention provides a method of disassembling and/or assembling stacked dispenser modules to facilitate repair or replacement. The exemplary method also facilitates installation of new or refilled dispenser modules in the machine. Existing dispenser mechanisms for automated banking machines may also be retrofit with dispenser modules of an exemplary embodiment of the invention.

BEST MODES FOR CARRYING OUT INVENTION

Figure 1:
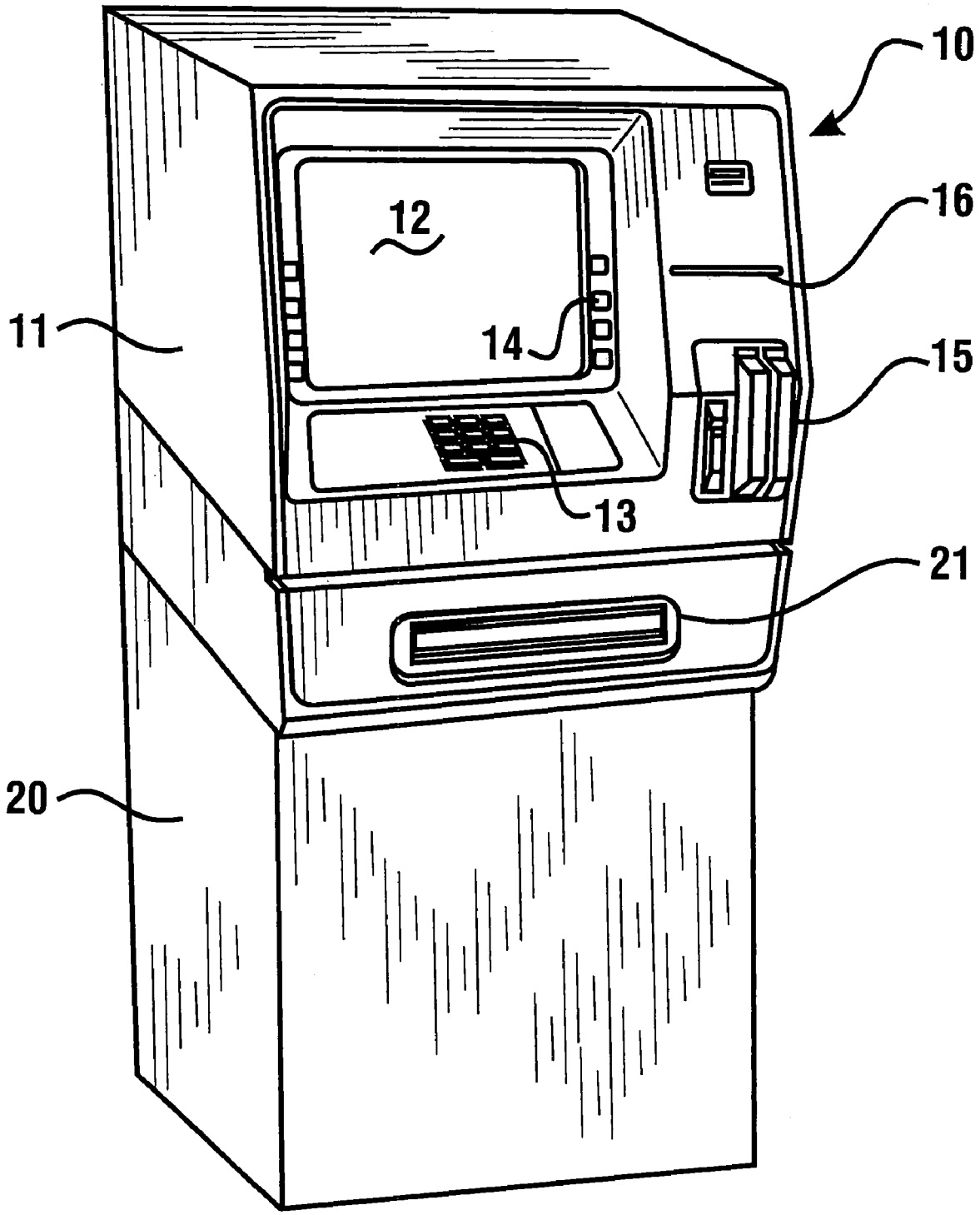
FIG. 1 is an isometric view of an automated banking machine used in connection with an exemplary embodiment of the invention.

Referring now to the drawings and particularly to FIG. 1 there is shown therein an automated banking machine, generally indicated by numeral 10, used in connection with an exemplary embodiment of the present invention. The automated banking machine 10 can be an automated teller machine (ATM). The automated banking machine 10 includes a customer interface portion and a document delivery portion.

The customer interface portion is supported on an upper housing 11. The interface portion can include a display 12, such as a CRT screen or other output devices for providing outputs such as visual messages and prompts to a customer or user. The interface can also include input devices, such as a keypad 13, function buttons 14, and a card reader 15. The customer interface portion can also include a receipt outlet 16 and may include other or different transaction function devices.

A document delivery portion of the machine 10 can be contained within a secure chest 20. An opening 21 is provided for delivery of sheets, such as currency, or other items to a user of the machine.

Other embodiments of automated banking machines used in connection with the invention may have a different type of user interface portion. For example, other embodiments may not include an interface portion on or adjacent to the chest portion. Such alternative machines may be operated as a document delivery device only. Such embodiments may be used to deliver sheets or documents to a cashier, bank teller, or other service provider. Such alternative embodiments may include a remotely positioned operator interface which selectively causes documents to be delivered through the opening 21.

Figure 2:
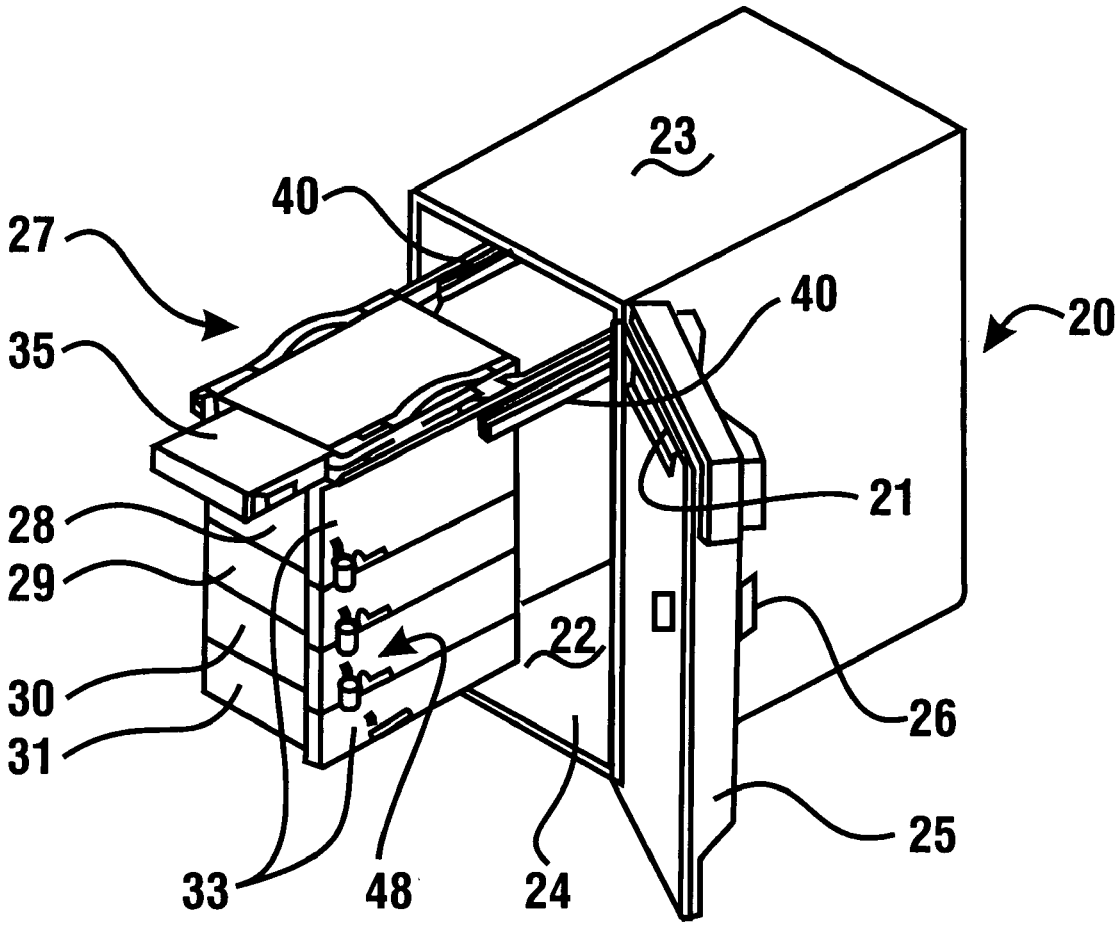
FIG. 2 is an isometric view of a secure chest portion with an access door open and a dispenser mechanism having locked dispenser modules extended through the opening.

In FIG. 2, the chest portion 20 of the banking machine is shown in more detail. The chest encloses a secure area 22. Chest 20 includes an upper wall 23 which can support the upper housing 11 and the customer interface portion of the banking machine in the exemplary embodiment shown in FIG. 1. Chest 20 also has a service opening 24, and a door 25 which can selectively close the opening 24. When the banking machine is in use, the area 22 is closed by the door 25 and is secured and locked through use of a locking device 26. Any of a number of devices may be used as a locking device 26 to secure the door in a closed position.

The secure area 22 of the chest 20 can be used to house numerous components of the banking machine. One of these components can be a sheet dispenser, generally indicated by numeral 27. The dispenser 27 includes removable cassettes 28, 29, 30, and 31. The cassettes can hold valuable documents or other sheet materials or media, such as currency, travelers checks, coupons, scrip, vouchers, wagering slips, stamps, tickets, and phone cards. Thus, a dispenser may be a multimedia dispenser. Each cassette has an associated picker which is selectively operative to remove items, such as currency sheets, from the cassette. The construction of the exemplary embodiment shown is such that a cassette is removably mounted in supporting connection with a dispenser module 33. However, a dispenser module may have more or fewer cassettes. The dispenser 27 is shown as having four dispenser modules 33. However, a dispenser may have more or fewer dispenser modules. Any number of dispenser modules may be included in a banking machine used in connection with the invention. Of course the number of dispenser modules may be limited by the physical size of the chest 20 or other enclosure. Although an exemplary embodiment of the invention has one cassette and document picker per dispenser module, other embodiments of the invention may have other numbers or arrangements of dispenser modules, cassettes, and pickers.

Dispenser modules 33 may be secured together in stacked relation. A document presenter 35 can be attached to the top of a stack of dispenser modules. Exemplary dispenser modules are shown in U.S. Pat. No. 6,293,540, the disclosure of which is incorporated herein by reference. Exemplary cassette and picker structures are shown in U.S. Pat. Nos. 6,629,694, 5,099,423 and 5,141,127, the disclosures of which are incorporated herein by reference. The stacked relation allows documents from the cassettes to be picked from the cassettes and delivered to the presenter 35. Documents may be selectively moved by the presenter through the opening 21 to a user of the machine.

In an exemplary embodiment each of the cassettes 28, 29, 30, 31 inside the dispenser 27 can be independently removable therefrom. Each cassette holding location in the dispenser 27 can include a document picker mechanism and belt feed which can operate to deliver documents to the presenter 35. The dispenser of the exemplary embodiment can include a plurality of feed rolls, belts, and other movable members for selectively engaging and moving documents. Motors and other drive devices can operate to move these movable members. The drive devices can operate in response to signals from a terminal controller, which can include one or more computers, which can control the dispensing of documents from the machine.

The dispenser 27, which includes the document presenter (or feeder) 35 and the dispenser modules 33, can be releasably engaged to a pair of slides 40. The slides can be mounted in supporting connection with the inside of the chest 20. This construction enables the slides and thus the dispenser 27 to be extended and retracted through the opening 24 into and out of the chest 20. In the operative position of the banking machine the dispenser 27 is supported by the slides 40. In an exemplary embodiment the dispenser 27 is releasably engaged with the slides and is removable therefrom when the dispenser is extended on the slides outside of the chest. In an exemplary embodiment the dispenser 27 is disengageable from the slides by moving the dispenser upward relative to the slides. Of course other approaches may be used for supportably mounting a dispenser in the machine.

When the banking machine is in use, the door 25 is closed. The slides 40 can be retracted resulting in the document presenter 35 and the dispenser modules 33 being generally positioned within the secure chest 20. The door 25 can be secured in a closed position with the lock device 26. Documents or other items can be dispensed responsive to signals from the terminal controller and delivered by the presenter 35 through the opening 21 which extends through the door 25. An exemplary form of a control system for use in connection with an automated banking machine is shown in U.S. Pat. No. 6,539,361 the disclosure of which is incorporated herein by reference.

It may be easily understood that the multitude of cooperating drives, feeders, movable members, and devices used in the dispenser to deliver documents from the machine, could malfunction. Periodic replacement or maintenance of certain components within the dispenser is also desirable to assure reliable operation. It may also be desirable in some circumstances to change the number of cassettes and picker mechanisms to accommodate different denominations of currency, coupons, stamps, or other documents. It may also be desirable to replace or upgrade a dispenser. It may also be desirable to add or to remove a dispenser from the machine. All of these activities can require procedures to be performed on the machine dispenser. Alternatively, it may be desirable to gain access to components in the chest of the banking machine which are rendered difficult to access by the presence of the dispenser and/or one or more components thereof.

The slides 40 of an exemplary embodiment enable service personnel to extend the dispenser 27 through the opening 24 once the door 25 has been opened. Extending the dispenser outward provides enhanced access to components of the dispenser for servicing. However, in some instances access to certain components of the dispenser or components in the chest cannot be easily obtained even with the dispenser extended through the opening 24. In these cases, it would be desirable to disengage the dispenser 27 from the slides 40 and move the dispenser in order for work to be performed, or even to possibly replace the dispenser. In other cases, the dispenser may need to be disassembled, including the unstacking of dispenser modules. The dispenser may then need to be reassembled, including the stacking of dispenser modules. In other embodiments the dispenser components may need to be disassembled and reassembled within the housing of the machine.

An exemplary embodiment provides for the aligning, stacking, and securing together of dispenser modules, yet also permits the dispenser modules to be easily separated. In some embodiments the dispenser modules can be assembled in stacked relation and disassembled quickly therefrom without the use of tools. Dispenser modules can be assembled in a stacked relation either initially (e.g., new dispenser module, new dispenser, etc.) or during a reassembling or reconfiguration process. As described hereinafter in further detail, a releasable locking arrangement can be used to position, align, and secure stacked dispenser modules together. A similar locking arrangement may also be used to secure the uppermost dispenser module to the document presenter. FIG. 2 shows an exemplary releasable locking arrangement, generally indicated by numeral 48, for adjacent dispenser modules 33.

Figure 3:
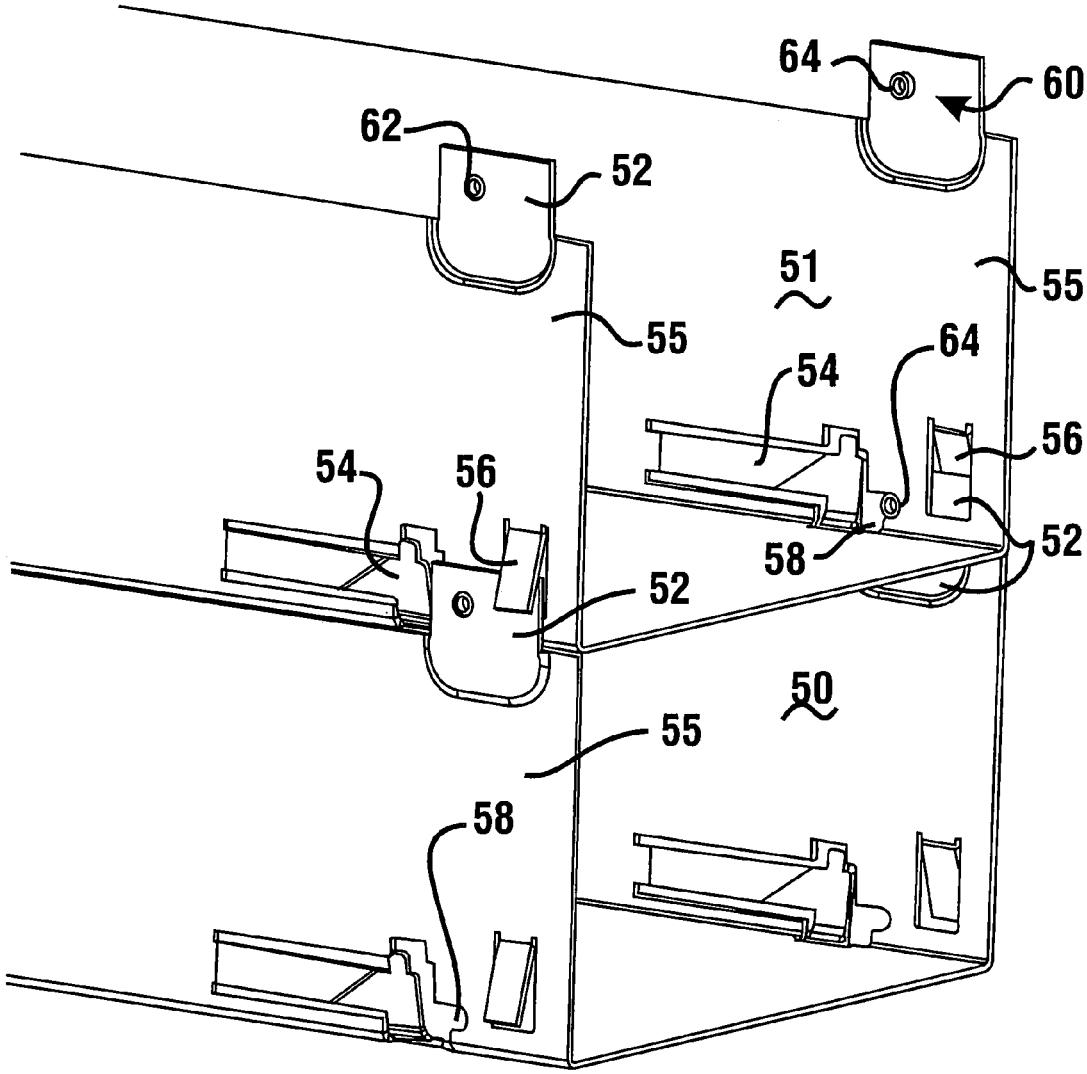
FIG. 3 shows a partial view of two removably connected dispenser modules.

FIG. 3 shows two exemplary dispenser modules 50, 51 secured together in a stacked relation or arrangement. Each dispenser module 50, 51 of the embodiment of FIG. 3 includes at least one projection 52, latch 54, and tab 56. The dispenser modules can be identical or they can differ, such as in dimensions (e.g., height). In other embodiments a designated top dispenser module may be without a projection. Likewise, in further embodiments a designated lowermost dispenser module may be without a latch and/or a guide. For ease of description, only one side wall 55 of a module need be described. The opposite side wall of a module can be symmetrical with the described side wall.

Dispenser module 50 can have a body, or a portion thereof, of material structurally sufficient to support the media cassette contained therein. For example, a module body may be comprised of metal, plastic, polymer, fiberglass, resin, wood, or glass, or combinations thereof. A module body may also have a clear material that permits viewing therethrough.

A dispenser module 50 can include a cutout portion, opening, recess, passage, or slot 58 in connection with a wall thereof. In the exemplary embodiment shown in FIG. 3 the slot 58 has the shape of an inverted L. Alternatively, a slot may have other shapes.

A projection member 52 can comprise a member or portion, such as a plate, which functions to extend from a module. A projection member 52 permits a first module 51 to be removably latched or locked to an adjacent module 50 when the modules are in properly stacked alignment. A projection member 52 can be attached to a module or be integrally formed with the module. Attaching or fastening may include known techniques, such as welding, screwing, bolting, use of nuts, etc.

Figure 7:
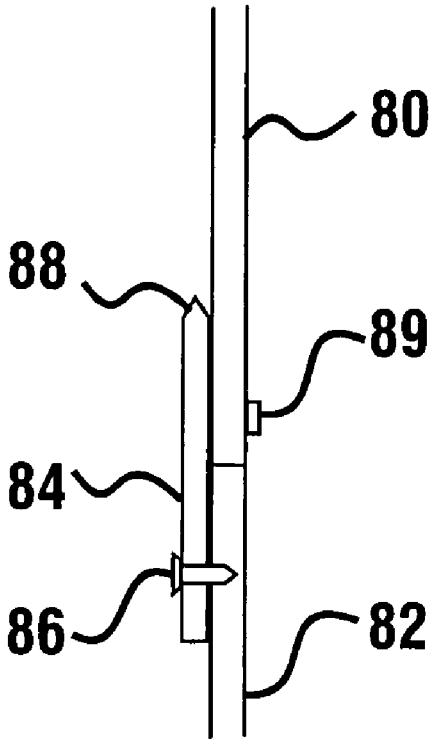
FIG. 7 shows an end view of an alternative form of side walls of connected dispenser modules.
Figure 8:
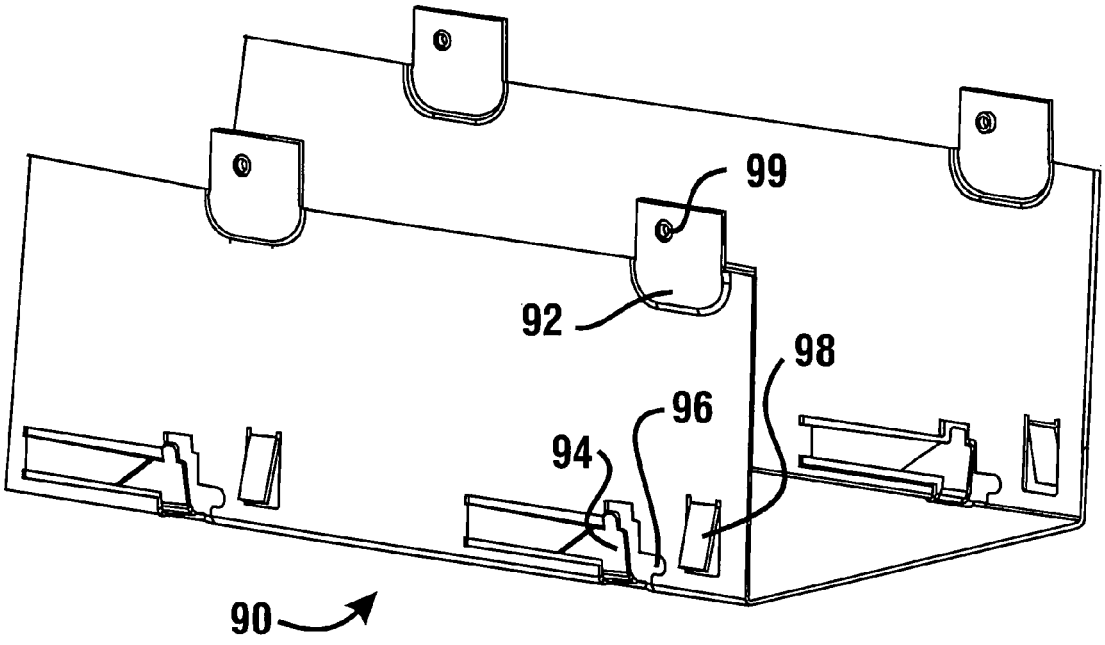
FIG. 8 shows a dispenser module with a plurality of releasable locking arrangements.

As shown in more detail in FIGS. 7 and 8, a projection member can project or extend from a module relatively flush with the module side wall. The projection may be biased toward remaining flush with the module side wall. Alternatively, a projection may extend outward away from a module side wall at a predetermined angle. For example, a projection may have an outwardly bias. In such case a tab can act to hold, pull, or retain a projection member adjacent a side wall. A projection member may also be tapered at the top thereof to assist in slidingly engaging an adjacent module.

The exemplary projection member 52 includes an inwardly projecting pin portion 60 which is referred to herein as a pin. The projecting pin 60 can comprise a dowel pin, bolt, shaft or other member. The pin 60 is of a length enabling its extension through an opening in a side wall 55 of an adjacent module. The pin 60 can be flanged at one or both ends. In an exemplary embodiment the pin has an enlarged, flanged end 62 in fixed connection with the projection member 52. Alternatively the pin 60 may be freely movable relative to the projection plate member 52. The pin 60 is adapted to extend both vertically and horizontally in the slot 58 of a module 50, 51. A flanged inner end 64 of the pin 60 is adapted to engage the side wall bounding slot 58 of an adjacent module.

A latch, retainer or arm 54 can be cut out from a wall bounding module body 50, 51. A guide or tab 56 can also be cut out from a wall of the module body. Alternatively, a latch and/or a guide can be separately fastened to a module body. Both latch 54 and guide 56 can serve as biasing members. For example, both a latch 54 and a tab 56 can serve as springs (e.g., latch spring and tab spring) in a manner similar to leaf springs. Both a latch 54 and a guide 56 can have an unbiased undeformed position, such as the position shown in the lower module 50 of FIG. 3. As discussed in more detail herein, a latch 54 can be used to latch or lock a dispenser module projection member 52 in stacked position, and thus lock the adjacent modules in stacked relation. A tab 56 can be used to guide or align a dispenser module projection member, and thus the modules, during stacking securement. A tab 56 can also be used to retain a projection 52 from (outward) movement away from its side wall.

An exemplary operation of assembling secured stacked dispenser modules will now be described. In the exemplary operation the engagement and movement of securing components can (symmetrically) simultaneously occur on each side of the modules.

Figure 4:
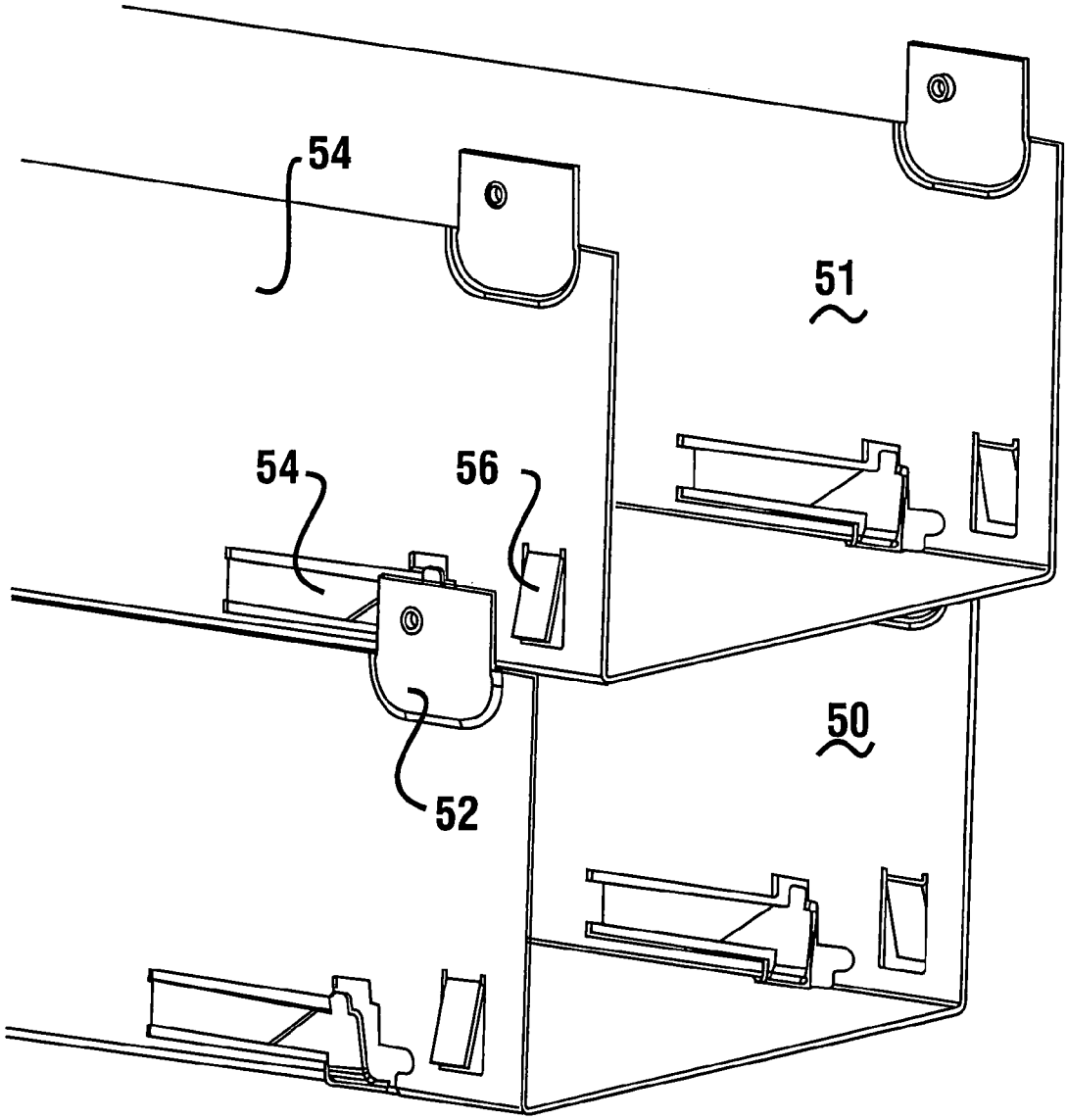
FIG. 4 shows a step in an exemplary process of connecting dispenser modules.

A first dispenser module 51 can be placed relatively into supporting connection with a second dispenser module 50, as shown in FIG. 4. In this step a latch arm 54 of the first dispenser module 51 is biased or compressed so as to be deformed inwardly relative to the module into the side wall 55 of the first dispenser module 51. This biased position may be achieved by the first module being lowered onto the second module at the position shown. Alternatively, the first module 51 may be placed relatively into supporting connection with the second module 50 upstream of the shown position (i.e., the projection 52 being further away from the tab 56) and then slid toward the shown position. The initial starting position may also vary based on how far a projection 52 is angled away from its side wall. For example, a projection 52 attached flush with its side wall may have to start in a position (further upstream) so that the projection 52 avoids abutting immovable engagement with an outwardly biased latch arm 54. That is, a module may have to be lowered (or raised) at a location that permits its lowering, i.e., the projection 52 is clear of contact with a latch arm 54. Alternatively, a module may be placed relatively into supporting connection with another module without any lowering, e.g., the modules can be horizontally slid relative to each other.

Figure 5:
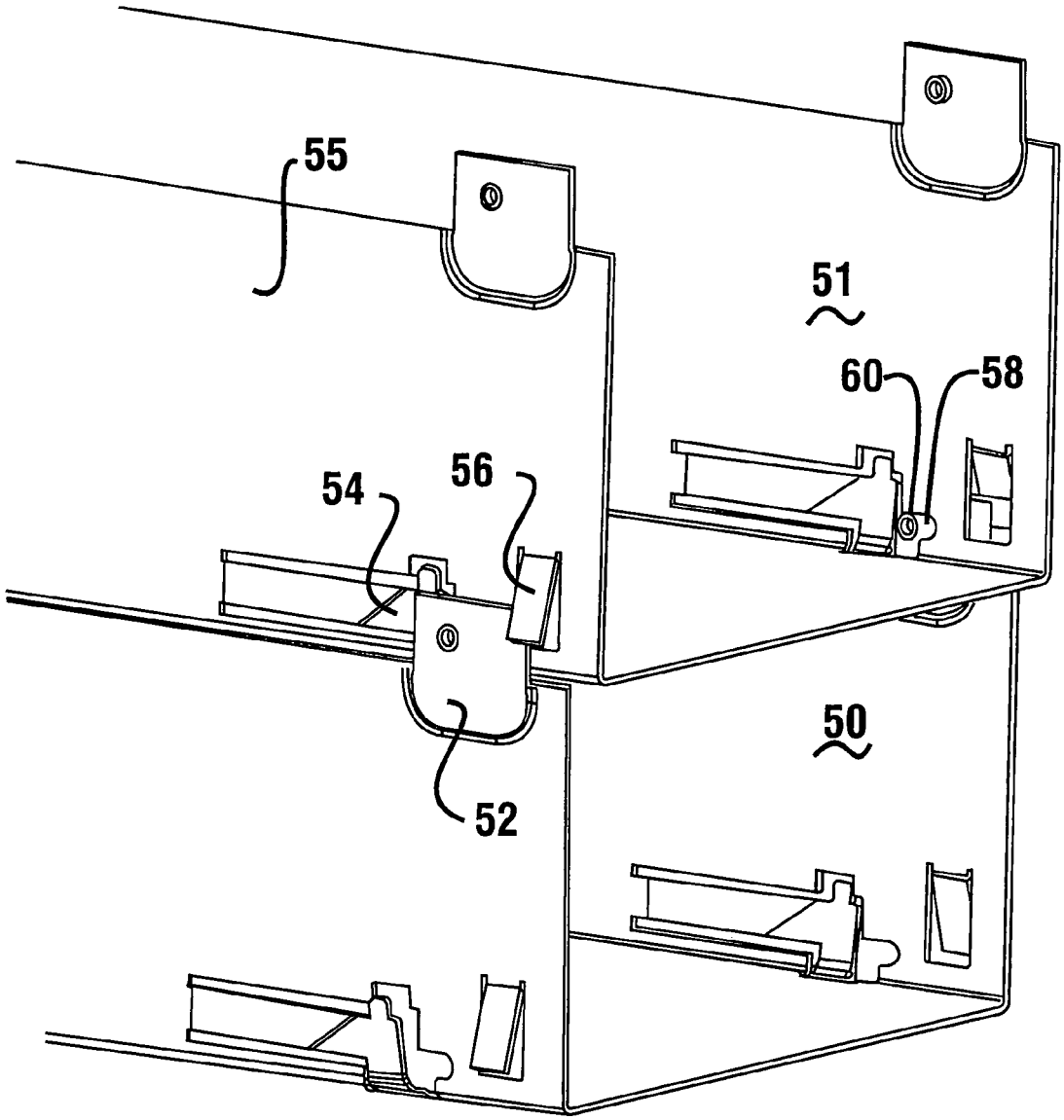
FIG. 5 also shows a step in the process of connecting dispenser modules.

In a next step, as shown in FIG. 5, the first module 51 can be slid further toward an aligned stacked relation with the second module 50. In this position the projections 52 of the second dispenser module 50 have respectively entered the gap that extends between the tabs 56 and the side walls 55 of the first module 51. Similarly, the pins 60 have entered into engaged relation with the slots 58. The tabs 56 can be used to guide, align, or biasingly retain a projection 52 during the stacking operation to secure the modules together. For example, the tabs 56 can be used to bias the projections 52 inward toward a flush arrangement with the side walls 55. Also, arrangements in other embodiments may be configured so the pins enter the slots before or after the projections enter behind the tabs. Of course these approaches are exemplary.

In a final step, as shown in FIG. 3, the first module 51 is slid further into aligned stacked relation with the second module 50. In this position the projections 52 of the second dispenser module 50 remain behind the tabs 56 of the first module 51. Furthermore, the pins 60 have slid (horizontally) to be engaged in the slots 58 and their inner flanged ends 64 are in retaining engagement with the side walls of the first module 51 bounding slots 58. Additionally, the projections 52 have slid past the latch arms 54. Thus, the latch arms 54 (which are no longer compressed by being biased inward) have again moved outwardly. That is, the latch arms 54 have snapped outwardly to prevent the projections 52 from disengaging by movement in the direction toward the latch arms. Thus, in this position the latch arms prevent the movement of the pins from the slots 58. It follows that the pin/slot arrangements and the latch/projection arrangements serve as interengaging projections and recesses that securely lock the adjacent modules 50, 51 in aligned and stacked relation.

In an exemplary embodiment of module stacking, a second dispenser module is placed on and locked to a first dispenser module to create a dispenser module stack portion. Thereafter, a third dispenser module may be placed on and secured to the already created dispenser module stack portion. The process can be repeated until the desired secured and aligned module stack containing a desired number of picking mechanisms is complete.

An exemplary operation of disassembling secured stacked dispenser modules will now be described. After the latch arms 54 are biased inwardly (i.e., compressed) then the projections 52 can again be moved outside of or into a position overlapping the compressed latch arms 54. The exemplary latch arms may be compressed by hand. In other embodiments use of a tool may be more convenient or necessary to compress the latch arms. The dispenser modules can then be moved parallel (e.g., horizontally) relative to each other until the pins 60 are aligned in a position for (e.g., vertical) removal from the slot 58 (e.g., the position shown in FIG. 5). Thereafter, the dispenser modules can be moved (e.g., vertically) relative to (away from) each other to disengage the modules. The pins can be removed by passing vertically through a lower portion of the slot, which portion extends (horizontally) inwardly.

Alternatively, the exemplary stacked modules may be disassembled by reversing the previously discussed assembly steps. For example, the latch 54 can be compressed far enough to permit the plate 52 (and the pin 60 therewith) to slide past.

Figure 6:
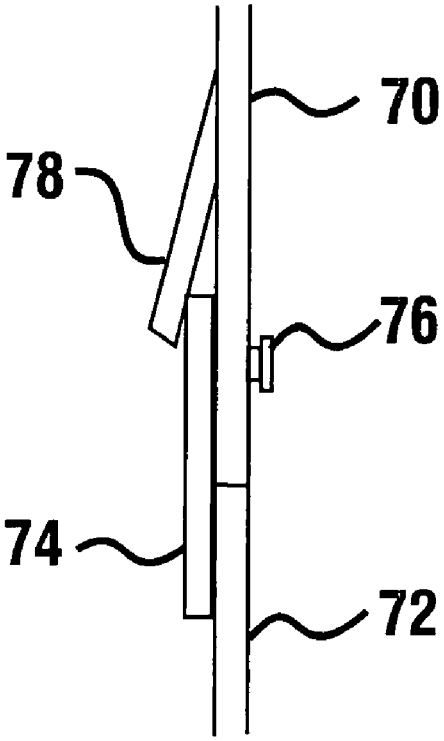
FIG. 6 shows a partial end view of adjacent side walls of connected dispenser modules.

FIG. 6 shows a partial end view of adjacent exemplary side walls 70, 72 of connected dispenser modules. A relationship of a projection member 74, an inner flanged pin end 76, a tab 78, and adjacent side walls 70, 72 is also shown.

FIG. 7 shows a partial end view of alternative side walls 80, 82 of alternative connected dispenser modules. A projection plate 84 is shown fastened to a side wall 80 via a screw 86. The projection plate 84 is also shown having a tapered end 88 and an extended pin 89.

FIG. 8 shows a portion of an exemplary dispenser module 90 including a plurality of releasable locking arrangements. Each of the arrangements includes a projection 92, latch arm 94, slot 96, tab 98, and pin 99.

Figure 9:
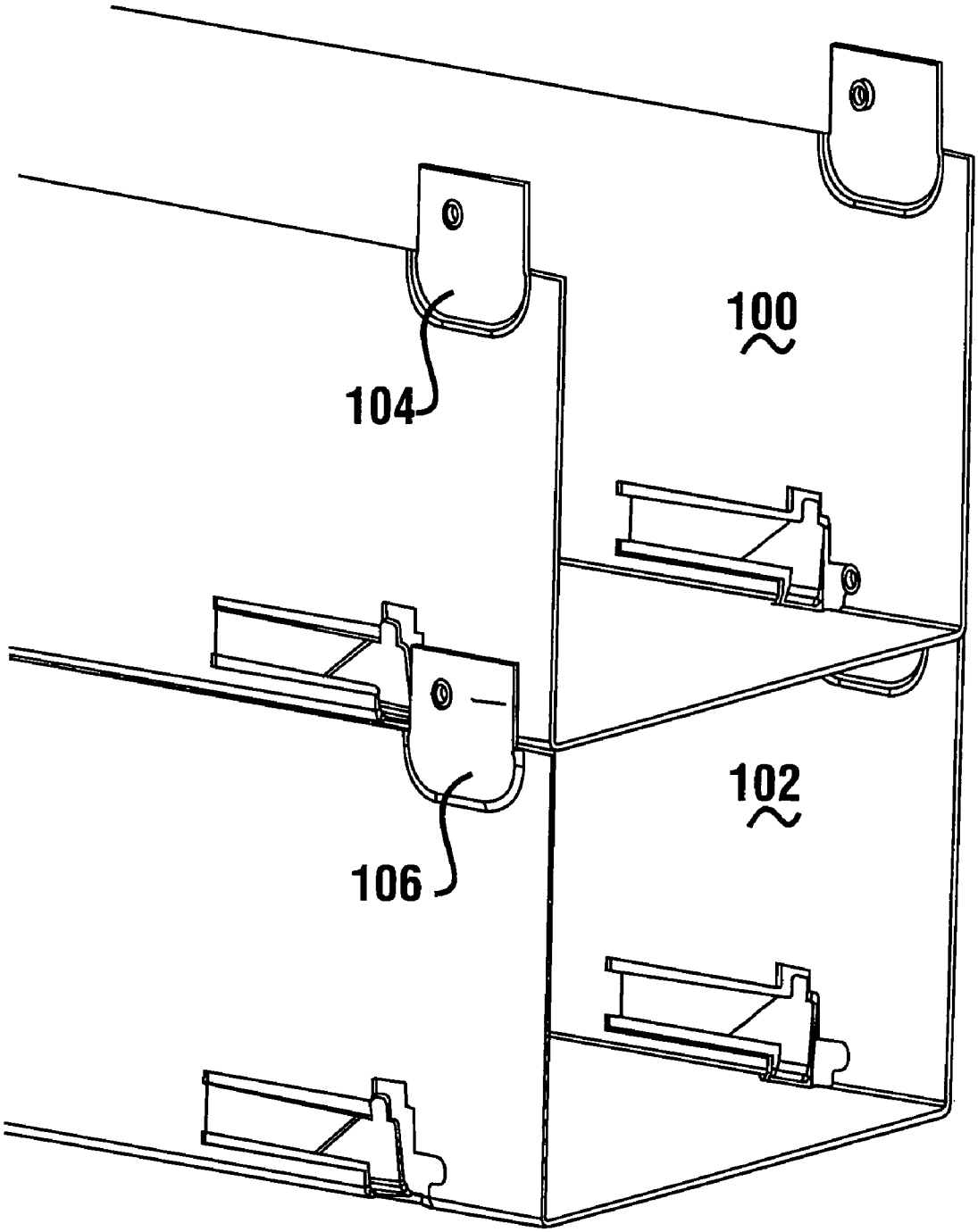
FIG. 9 shows a partial view of removably connected alternative dispenser modules.

FIG. 9 shows a portion of removably connected alternative dispenser modules 100, 102. The modules are similar to those of FIG. 3, except tabs are absent and (correspondingly) the projections 104, 106 are of smaller size. It should be understood that the sizes and locations of the projections, latches, tabs, pins, and slots may vary for different modules. For example, a stack of modules may have vertically alternating (relatively) small and large sized projections. That is, the lowermost module may have small sized projections and the next level module may have large sized projections. The other module structure (e.g., latches, slots, etc.) may also be sized to correspond to the sized projections of the adjacent modules.

Furthermore, in some embodiments the locking arrangements of the modules in a stack may vary so that the stack may only be assembled one way. That is, the order of the modules in a stack can be determined by their predetermined locking arrangements. Thus, service personnel can be prevented from incorrectly stacking modules.

The exemplary embodiments may also facilitate the addition of additional dispenser modules to a dispenser. In situations where an ATM is desired to be configured to dispense additional types of documents, additional dispenser modules may be added. Additional dispenser modules may also be added in situations where it is desired to add additional document dispensing capacity for a type of document already dispensed by the machine. Of course, as can be appreciated the exemplary embodiments also enable removing dispenser modules to eliminate document types or to reduce capacity.

While in an exemplary embodiment the dispenser modules are used as a supporting structure for sheet dispensers, in other embodiments the module structure can be used for housing structures associated with sheet acceptors and/or sheet recycling mechanisms. Such mechanisms may be of the type shown in U.S. Pat. No. 6,331,000 the disclosure of which is incorporated herein by reference.

An exemplary embodiment provides for the capability of using removably lockable multimedia dispenser modules to facilitate the servicing of automated banking machine dispenser mechanisms. The exemplary embodiment can permit easier, faster, and less expensive access to dispenser mechanism components to facilitate repairs and/or replacement thereof by service personnel. The present invention can also provide a method of separating and removing stacked modules of a dispenser assembly to facilitate repair or replacement. An exemplary method of the present invention also facilitates aligning and releasably locking together the modules of a dispenser mechanism in an automated banking machine, such as an ATM.

While the exemplary embodiments include particular structures to achieve the desirable results, those having skill in the art may devise numerous other embodiments with other structures which employ the same inventive principles described herein and which are encompassed by the subject matter as claimed. For example and without limitation, other embodiments may include other types and shapes of modules, projections, pins, latches, slots, tabs, fasteners, material, or other structures. Further, the structures described herein are not intended to limit the method of the invention to the particular structures described herein.

Thus the exemplary embodiments of the present invention achieve one or more of the above stated objectives, eliminate difficulties encountered in the use of prior devices and methods, solves problems, and attain the desired results described herein.

In the foregoing description certain terms have been used for brevity, clarity and understanding, however, no unnecessary limitations are to be implied therefrom because such terms are intended for descriptive purposes only and are intended to be broadly construed. Moreover, the descriptions and illustrations herein are by way of examples and the invention is not limited to the exact details shown and described.

In the following claims, any feature described as a means for performing a function shall be construed as encompassing any means known to those skilled in the art to be capable of performing the recited function and shall not be deemed limited to the particular structure shown herein or equivalents thereof.

Having described the features, discoveries and principles of the invention, the manner in which it is constructed and operated, and the advantages and useful results attained; the new and useful structures, devices, elements, arrangements, parts, combinations, systems, operations, methods and relationships are set forth in the appended claims.

We claim:

1. A method comprising:

(a) placing a first dispenser module adjacent a second dispenser module, wherein the modules are operative to store sheet items dispensable by an automated banking machine;

(b) deforming at least one biasing member portion operatively connected to the first module by engagement with at least one projection member portion operatively connected to the second module;

(c) subsequent to (b), moving the first module relative to the second module with the at least one biasing member portion biasingly deformed, wherein the first module is moved in an alignment direction toward an operative aligned position with the second module;

(d) further moving the first module relative to the second module in the alignment direction until the at least one deformed biasing member portion moves responsive to biasing force, wherein the at least one moved biasing member portion operatively prevents movement of the first module relative to the second module in a direction opposite the alignment direction.

2. The method according to claim 1 wherein the modules each include at least one side wall having at least one face, and wherein (a) includes positioning at least one projection member portion operatively connected to the second module adjacent and outwardly disposed relative to at least one side wall face of the first module, and wherein (b) includes deforming at least one biasing member operatively connected to the first module inwardly relative to the at least one side wall of the first module.

3. The method according to claim 2 wherein the at least one projection member portion includes a pin portion extending generally perpendicular to the side wall face, wherein the side wall face of the first module includes a recess in operative connection therewith, and step (c) includes:

moving the pin portion in the recess.

4. The method according to claim 3 wherein the pin portion includes an enlarged portion, wherein the enlarged portion is unable to pass through an engaging portion of the recess, and wherein (d) includes:

moving the pin portion in the recess so that the enlarged portion of the pin portion is unable to pass through the engaging portion of the recess.

5. The method according to claim 4 wherein (d) includes releasibly locking the first and second modules in the operative aligned relation.

6. The method according to claim 3 wherein a side wall face of the first module is operatively connected to a biasing tab portion, and wherein (c) includes:

relatively moving the projection member portion intermediate of the tab portion and the side wall face of the first module.

7. The method according to claim 6 wherein (d) includes:

retaining the projection member portion operatively connected to the second module, intermediate of the tab portion and the side wall face of the first module.

8. The method according to claim 1 and further comprising subsequent to step (d):

(e) biasingly deforming the biasing member portion to enable movement of the first module relative to the second module in a direction opposite the alignment direction.

9. The method according to claim 1 wherein(d) includes locking the first and second modules in stacked operatively aligned position, and subsequent to(d) further comprising:

deforming the biasing member portion to unlock the modules from each other.

10. A method comprising:

in a sheet dispensing automated banking machine comprising a plurality of modules, (a) moving at least one biasing member portion operatively attached to a first module, wherein moving the at least one biasing member portion enables the first module to move relative to a second module and away from an aligned position with the second module, wherein in the aligned position the first and second modules are engaged with each other, and wherein in the aligned position each of the first and second modules are operatively positioned in the machine to at least one of dispense currency sheets therefrom and receive currency sheets therein;

(b) subsequent to (a), moving the first module relative to the second module to disengage the first and second modules from each other.

11. A method comprising:

in a sheet dispensing automated banking machine comprising a plurality of modules, each module adapted to at least one of dispense currency sheets from or receive currency sheets in the module, (a) moving at least one biasing member portion operatively attached to a first module, wherein moving the at least one biasing member portion enables the first module to move relative to a second module away from an operative and aligned position of the first and second modules, wherein in the operative and aligned position each of the modules are enabled to be operative in the machine to at least one of dispense currency sheets from and receive currency sheets in the module;

(b) subsequent to (a), moving the first module relative to the second module to disengage the first and second modules, wherein relative movement of the first and second modules disengages a plurality of interengaging projections and recesses holding the first and second modules in engagement in the operative and aligned position.

12. The method according to claim 11 wherein the second module includes a pair of disposed projecting portions, and wherein in the operative and aligned position of the first and second modules, the disposed projection portions are operative to hold the first and second modules in locked and engaged relation, and wherein moving the at least one biasing member portion in (a) enables each of the pair of projecting portions to be moved relative to the first module.

13. The method according to claim 12 wherein each of the projecting portions include a pin portion, and wherein each of the pin portions extend in an inward direction relative to the second module when the first and second modules are in the operative and aligned position, and wherein each pin portion is engaged in a recess of the first module, and wherein (b) includes moving each of the pin portions relative to each respective recess.

14. The method according to claim 13 wherein each recess includes a generally L shaped portion and wherein (b) includes moving the first and second modules relative to one another first in a first direction and thereafter in a second direction generally perpendicular to the first direction.

15. The method according to claim 14 wherein the first module has connected thereto a pair of biasing member portions, each of the biasing member portions operatively engaging and preventing relative movement of a respective projecting portion in the operative and aligned position of the first and second modules, and wherein (a) includes moving each of the pair of biasing member portions inwardly relative to the first module.

16. The method according to claim 15 wherein the second module includes two disposed walls, and wherein each biasing member portion is integrally formed with a respective one of the walls, and wherein (a) includes inwardly moving each of the biasing member portions relative to each of the walls.

17. The method according to claim 16 wherein each of the pair of disposed walls includes a tab portion operatively connected thereto, and wherein (b) includes moving each projecting portion from intermediate relation between a respective tab portion and a respective wall.

18. The method according to claim 17 wherein the machine includes a third module, wherein the third module remains in an operative and aligned position with the first module after (b), and further comprising subsequent to (b):

(c) disengaging the first module and the third module from each other.

19. The method according to claim 18 wherein (c) includes:

(i) moving at least one further biasing member portion operatively attached to the third module, wherein moving the at least one further biasing member portion enables the first module to move relative to the third module;

(ii) moving the first module relative to the third module to disengage a plurality of interengaging projections and recesses operatively connected to the first and third modules.

20. The method according to claim 10 and further comprising:

(c) disconnecting at least one of the first module and second module from a presenter mechanism operative to present currency sheets from the machine.

21. The method according to claim 10 and subsequent to (b):

(c) moving the first module relative to the second module to reengage the first and second modules in the operative and aligned position.

22. A method comprising:

in a sheet dispensing automated banking machine comprising at least one module adapted to at least one of dispense currency sheets from and receive currency sheets in the module, (a) moving a first module in adjacent relation to a second module, wherein at least one of the first module and the second module include a plurality of projections and recesses;

(b) moving the second module relative to the first module to cause the projections to enter recesses and to lock the first module and the second module to each other in an aligned position through biasing movement of at least one deformable biasing member portion.

23. The method according to claim 22 wherein (a) includes moving the first module and second module into generally vertically aligned relation.

24. The method according to claim 23 wherein (b) includes moving the first module and second module generally horizontally relative to one another.

25. The method according to claim 24 wherein in (a) the at least one deformable biasing member portion is deformed by the first module and second module being moved in generally vertically aligned relation, and in (b) the at least one deformable biasing member portion moves responsive to horizontal movement of the first module relative to the second module to hold the modules in the aligned position.

26. The method according to claim 25 and subsequent to (b):

(c) moving the at least one deformable biasing member portion;

(d) subsequent to (c) moving the first module generally horizontally relative to the second module whereby the first module and second module are enabled to be separated.

27. The method according to claim 22 and prior to (a) unlocking a door of a chest portion, wherein unlocking the door enables accessing at least one module.

28. The method according to claim 22 and further comprising:

(c) disconnecting the first module from a sheet presenter mechanism of the machine.

29. The method according to claim 28 wherein (c) includes (i) moving at least one biasing member operatively connected to at least one of the first module and presenter mechanism, (ii) moving the first module relative to the presenter mechanism to disengage a plurality of interengaging projections and recesses each operatively attached to at least one of the first module and presenter mechanism.

30. The method according to claim 25 and further comprising:

(c) dispensing currency sheets from the at least one second module.

31. The method according to claim 25 and further comprising:

(c) receiving currency sheets into the at least one second module.

32. The method according to claim 30 and prior to (c) positioning at least one sheet holding cassette in the at least one second module, wherein in (c) the currency sheets are dispensed form the at least one cassette.

33. The method according to claim 31 and prior to (c) positioning at least one cassette in the at least one second module, wherein in (c) the currency sheets are received within the at least one cassette.

* * * * *